US006209889B1

(12) United States Patent
Alfieri et al.

(10) Patent No.: US 6,209,889 B1
(45) Date of Patent: Apr. 3, 2001

(54) IN-LINE ROLLER SKATE

(75) Inventors: Fabio Alfieri, Treviso; Roberto Gorza, Feltre; Francesco Caeran, Montebelluna, all of (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 09/307,606

(22) Filed: May 10, 1999

(30) Foreign Application Priority Data

May 14, 1998 (IT) ..... TV98A0078

(51) Int. Cl.[7] ..... A63C 17/06

(52) U.S. Cl. ..... 280/11.224; 280/11.225; 280/11.231; 280/11.28

(58) Field of Search ..... 280/11.15, 11.22, 280/11.27, 11.28, 11.221, 11.223, 11.224, 11.225, 11.231

(56) References Cited

U.S. PATENT DOCUMENTS

| | | | | |
|---|---|---|---|---|
| 396,413 | * | 1/1889 | McQuown | 280/11.15 |
| 619,327 | * | 2/1899 | Miner | 280/11.15 |
| 1,228,544 | * | 6/1917 | Falstrem et al. | 280/11.15 |
| 1,603,588 | * | 10/1926 | Eferle | 280/11.15 |
| 1,702,316 | * | 2/1929 | Ridgers | 280/11.15 |
| 1,751,692 | | 3/1930 | Frühbeis . | |
| 5,904,359 | * | 5/1999 | Caeran et al. | 280/11.22 |
| 5,931,480 | * | 8/1999 | Schroeder | 280/11.28 |
| 6,039,328 | * | 3/2000 | Burns et al. | 280/11.22 |

FOREIGN PATENT DOCUMENTS

| | | |
|---|---|---|
| 42 09 771 | 9/1993 | (DE) . |
| 0 778 058 | 6/1997 | (EP) . |
| 2 752 170 | 2/1998 | (FR) . |
| 9 732 637 | 9/1997 | (WO) . |

* cited by examiner

*Primary Examiner*—Michael Mar
(74) *Attorney, Agent, or Firm*—Guido Modiano; Albert Josif; Daniel O'Byrne

(57) ABSTRACT

A skate which includes a shoe having a first frame and a second frame for supporting one or more wheels. The first frame and the second frame, or the sole of the shoe, are articulated in a region which lies approximately below the metatarsus of the foot in order to allow better flexing. An adjustable fork is also provided between the first frame and the sole and is adapted to force the planar arrangement of the shoe once thrusting has ended.

18 Claims, 3 Drawing Sheets

IN-LINE ROLLER SKATE

BACKGROUND OF THE INVENTION

The present invention relates to an in-line roller skate.

Conventional skates are substantially constituted by a rigid shoe associated with a frame for supporting either wheels or an ice-skating blade.

The main drawback of conventional skates is the fact that the rigidity of the shoe or of the frame for supporting the wheels or the ice-skating blade prevent the normal articulation of the foot during skating.

U.S. Pat. No. 1,603,588 discloses a soft shoe having a sole associated with either a blade, constituted by two separate components which are mutually articulated approximately in the region below the plantar arch, or with a wheel supporting frame, which is again composed of two parts which are mutually hinged in the region below the plantar arch.

Although the above skate allows the articulation of the shoe and therefore of the foot during skating, a considerable drawback is constituted by the fact that the hinge for the mutual articulation of the parts of the blade or of the wheel support is far backward and entails a difference in the position of the rotation axis of the foot with respect to the shoe and the frame or blade.

In this manner, the natural rotation of the metatarsal region is compromised because the sole of the shoe is rigid at this region of the foot, while the sole of the shoe moves with respect to the foot, thus reducing its sensitivity with respect to said shoe and accordingly compromising optimum control and steering of the skate.

EP-0 686 412 discloses a roller skate with improved fit which is constituted by a first front body, for supporting and securing the front part of the foot, and by a second rear body, for supporting and securing at least the heel; said bodies are transversely and rotatably associated with each other, and each body is provided with a frame for supporting one or more wheels.

The two elements are rotatably connected to each other by means of studs or pivots and the movement is guided by a tab which protrudes from the front element and is arranged on the front part of the sole and of the shell.

In the above skate, the studs or pivots that are fixed to the side walls of the shell are subjected to a large number of movements and stresses caused by sports practice. In the course of time, these movements can compromise the efficiency and in particular the alignment of the first front body and of the second rear body.

It is also noted that the limited length of the elements for mutually connecting the first body and the second body tends to compromise the torsional properties of the entire skate and does not ensure the performance required for correct and comfortable use.

CA-2,155,444 discloses a skate which comprises a shoe whose sole has one or two transverse hinges formed approximately at the region where the foot flexes. In order to allow articulation, below the region of the tip of the shoe there is an additional hinge for an. ice-skating blade which is associated, in a rear region, with the sole of the shoe so as to allow the articulation of said shoe.

A similar configuration is provided if the shoe is associated with a frame for supporting in-line wheels.

The above skate follows the natural movement of the foot, but at the same time it does not ensure the adequate technical characteristics required for sports practice, because, for example, the seat for the frame or blade provided in the rear region of the shoe is formed with plays which allow it to perform a combined rotary and translatory motion. This in no way ensures adequate lateral support and torsional strength, particularly during side-slip braking, which is notoriously the most trying step for the rear region of the skate.

EP-0 774 282 discloses a skate with in-line wheels which comprises a shoe associated a wheel supporting frame which has, approximately in a median region, a cutout which divides the frame into two components and forms a deformable region which allows the articulation of the two components of the frame. An elastic element is interposed between said components and is adapted to improve their return to the horizontal position.

In the above skate, it is noted that the deformation region, and therefore the corresponding flexing region of the shoe, do not meet the anatomical requirements of the foot because it is observed that the position of the rotation axis is distinctly too far back with respect to the natural axis of rotation of the metatarsus.

WO-97/18019 discloses a skate which is again composed of a shoe associated with a wheel supporting frame which is composed of two half-frames which are mutually rotatably connected by means of a common mechanical hinge which is located approximately in the vicinity of the axis of the second wheel starting from the front end of the shoe.

An elastic element is inserted approximately in the region located directly above the hinge, and its ends rest at the two half-frames, so as to facilitate the return of said two half-frames to the initial position.

One drawback that can be noted is the position of the elastic element which, by being very close to the hinge, considerably reduces the sensitivity of said hinge to small movements or depressions in the ground, thus making the skate very rigid and in practice limiting the flexing of the foot considerably.

SUMMARY OF THE INVENTION

An aim of the present invention is to solve the above-mentioned problems, eliminating the drawbacks of the cited prior art by providing a skate which allows the foot to perform, as much as possible, a natural movement while skating.

An object of the invention is to provide a skate which effectively follows the natural flexing of the foot during skating.

Another important object is to provide a skate which allows to accumulate, during the flexing of the foot, energy which then be returned during the final step of thrusting.

Another important object is to provide a skate which maintains its rigidity characteristics, which are necessary for its correct use.

Another object is to provide a skate which is structurally simple and can be manufactured with conventional machines and equipment.

This aim, these objects and others which will become apparent hereinafter are achieved by a skate comprising a first frame and a second frame for supporting wheels or blades, characterized in that said first and second frames respectively have a first base and a second base which are articulated, at one end, by means of an hinge which is located at a region that lies approximately below the metatarsus of the foot.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figure 1:
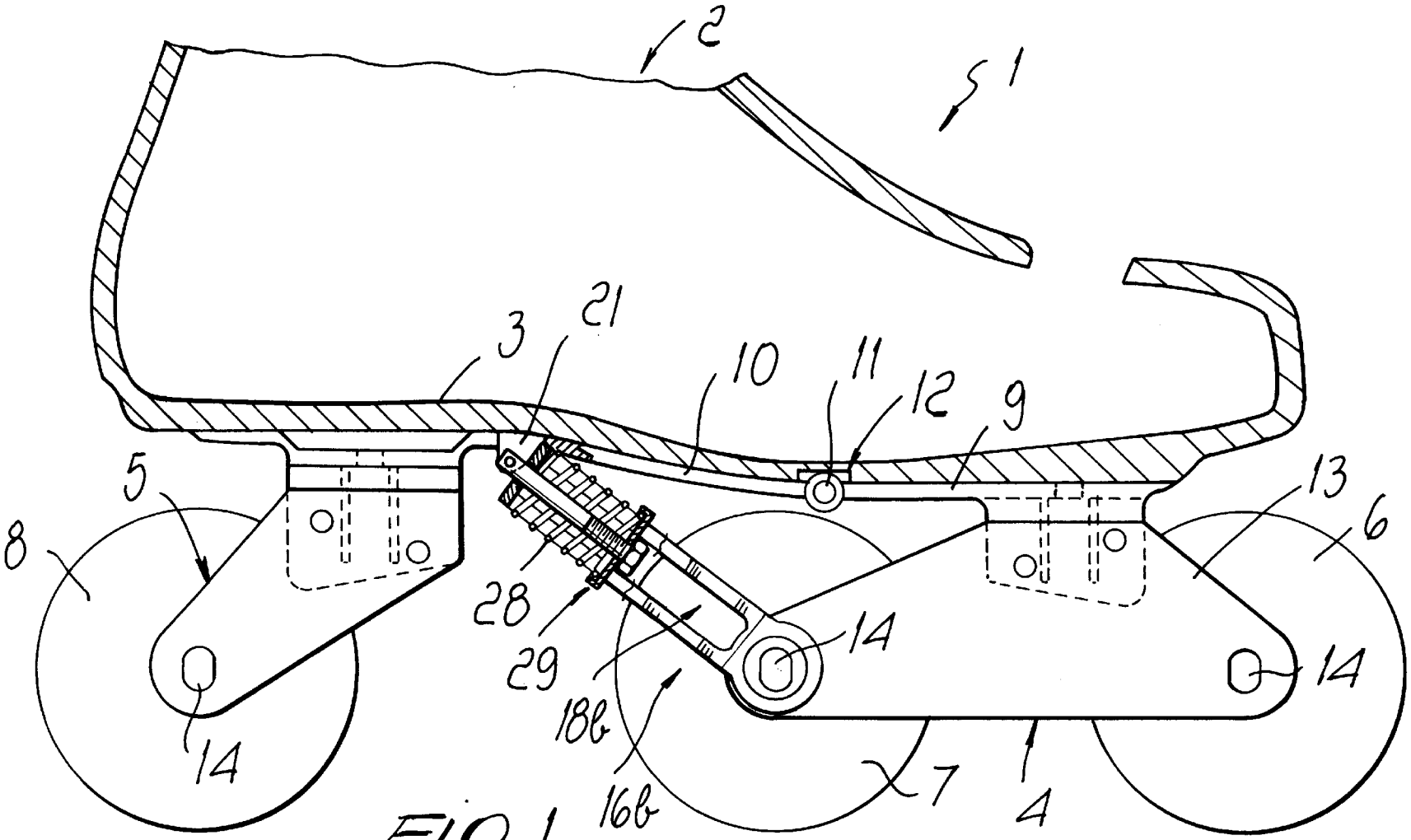
FIG. 1 is a partially sectional side view of the skate.
Figure 2:
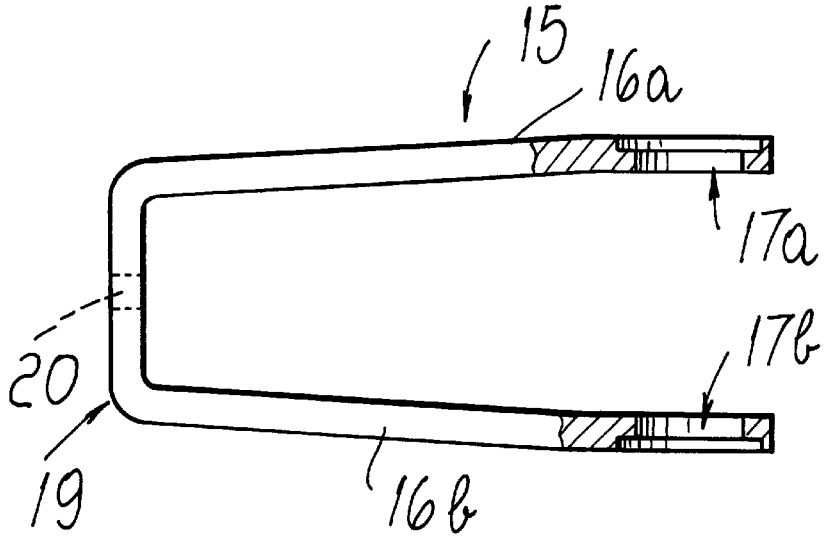
FIG. 2 is a partially sectional plan view of a component and of the adjustable means for forcing the planar arrangement of the shoe.
Figure 3:
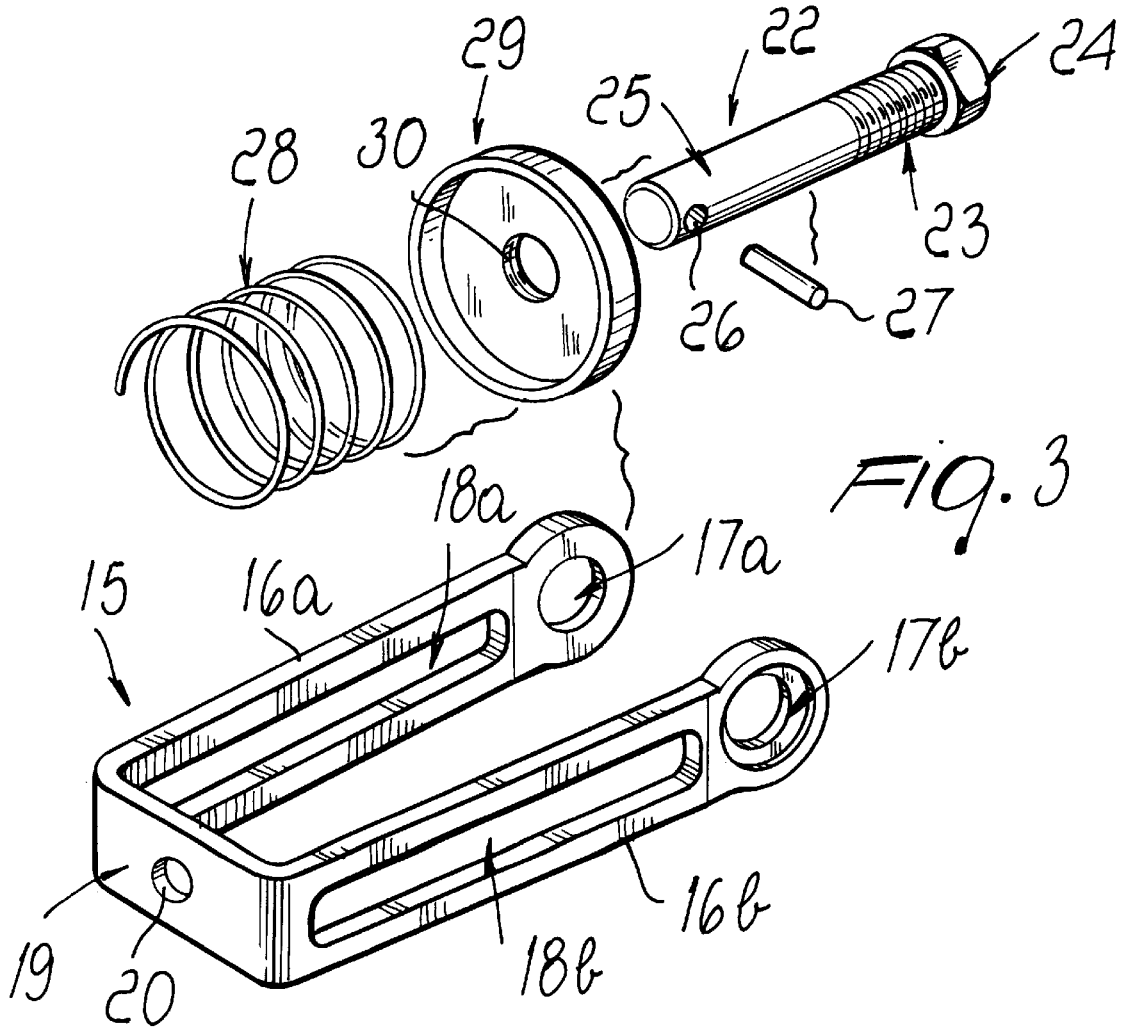
FIG. 3 is an exploded view of said adjustable means.

With reference to the above figures, the reference numeral 1 designates a skate which is constituted by a shoe 2, of the rigid or soft type, which has a sole 3 below which a first frame 4 and a second frame 5 are associated for respectively supporting a front wheel 6 and an intermediate wheel 7 and a rear wheel 8.

In the illustrated embodiment, the first frame and the second frame respectively have a first base 9 and a second base 10, which are articulated, at one end, by means of an hinge 11 which acts at a first seat 12 formed at the sole 3.

The hinge 11 is located at a region that lies approximately below the metatarsus of the foot within the space between the vertical axes of the front wheel 6 and of the intermediate wheel 7.

The first seat 12 is formed at the sole 3 of the shoe 2 and allows said sole to flex if rigid.

The first and second frames are each substantially shaped like an inverted letter U and said wheels 6, 7 and 8 are pivoted between the wings 13 of said frames by means of adapted first pivots 14.

The skate thus provided also comprises a shoe which, during sports practice, follows the movements of the foot closely and does not hinder any movement.

This is also allowed by a fork means interposed between the first frame 4 and the sole 3 of the shoe 2. The fork means is constituted by a fork 15 which is composed of two arms 16*a* and 16*b*, the tips thereof have first holes 17*a* and 17*b* which have the same axis and form seats for coupling at the first pivot 14 or at the optional screw for the articulation of the intermediate wheel 7 to the first frame 4.

Longitudinal slots 18*a* and 18*b* are provided at the arms 16*a* and 16*b*, while at the base 19 that connects said arms there is a second central hole 20.

The extension of the arms is such as to allow to place the base 19 adjacent to the sole 3 of the shoe 2, and a tab 21 protrudes downward from said sole.

A screw 22 can be interposed between the arms 16*a* and 16*b* and has a first threaded portion 23, which is adjacent to the head 24, and a second smooth portion 25, proximate to the tip of which there is a third diametrical through hole.

The free tip of the screw 22 is rotatably connected at the tab 21, for example by using a second pivot 27 which passes at said third hole 26 and at a corresponding hole formed at the tab 21.

A flexible element, such as a spring 28, is arranged coaxially to the screw 22; its ends abut at the surface of the base 19 that is directed away from the tab 21 and at a stop element which is constituted by a cap 29 which has a substantially C-shaped transverse cross-section and is provided with a fourth axial hole 30 which is internally threaded complementarily to the first threaded portion 23 of the screw 22.

Accordingly, during skating a flexing of the foot is also matched by the flexing of the shoe 2, which accordingly moves the screw 22, which loads the spring 28, which therefore accumulates energy during the flexing of the skate.

This energy is returned during the final step of thrusting, when the load applied by the movement to the skater becomes smaller than the force developed by said spring.

Figure 4:
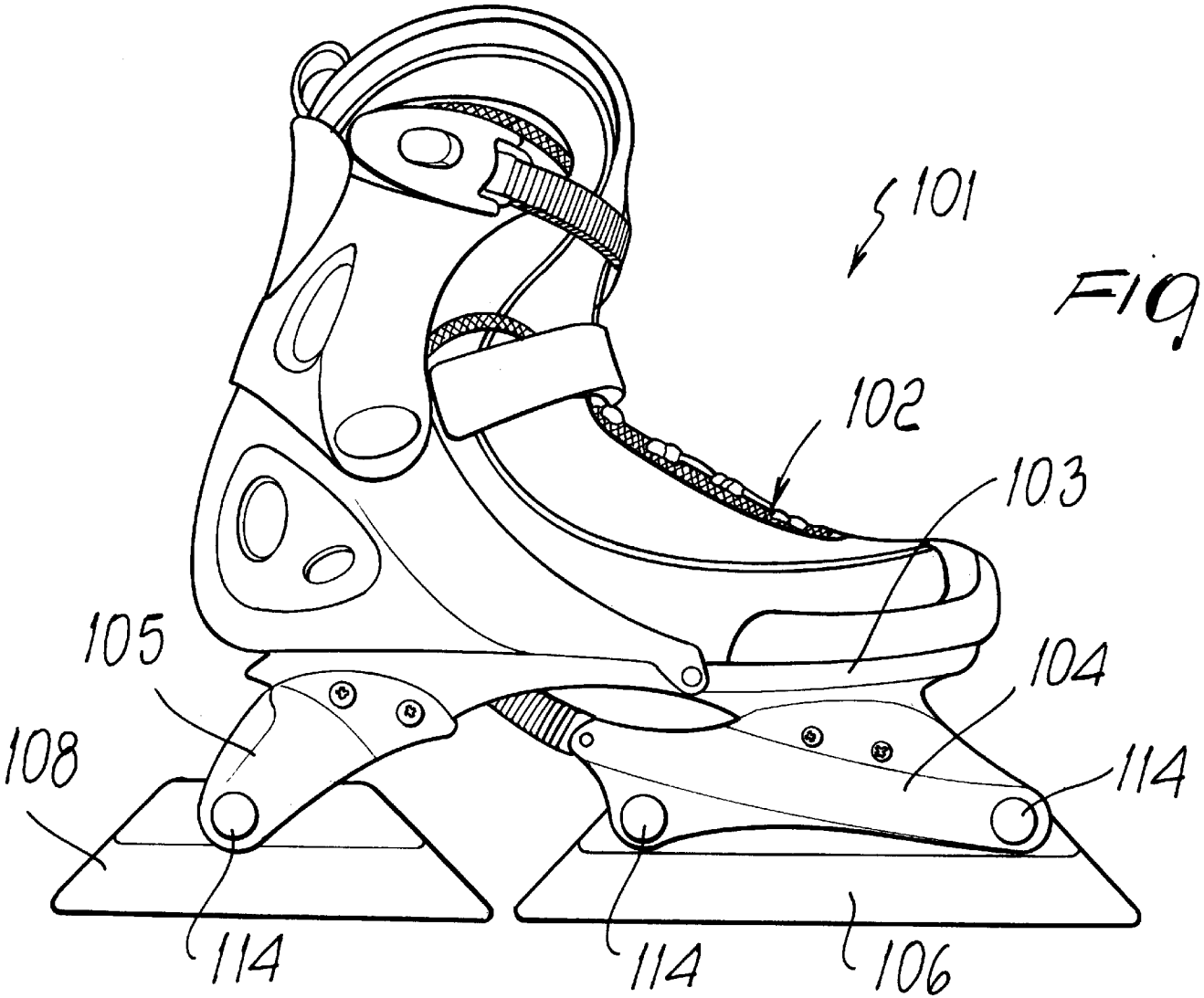
FIG. 4 is a side view of an ice skate according to a further aspect of the invention.

FIG. 4 shows an ice skate 101, according to a further aspect of the invention, provided with a shoe 102 associated with a main frame 103 which supports a first front frame 104 and a second rear frame 105. First frame 104 has at least two pivots 114 adapted to support either a front blade 106, as illustrated in FIG. 4, or two wheels, as in the above embodiment. Second frame 105 has at least one pivot 114 for supporting a second blade 108, as in the illustrated case, or a wheel.

One single blade (not illustrated) may be associated with the first and second frames 104 and 105 instead of the first and second blades 106, 108. In this case, the advantage of the articulated blades would be lost but the skate would be more useful for speed skating.

It has thus been observed that the invention has achieved the intended aim and objects, a skate having been provided which adapts to the natural movement of the foot, at the same time improving its technical characteristics, since the flexing region of the skate corresponds to the region where the foot flexes.

Furthermore, the arrangement of the rotation axis of the skate between the axes of the two front wheels gives greater stability to the skater, enhancing the thrusting force.

Finally, energy is allowed to accumulate during the flexing of the foot and is returned during the final step of thrusting.

The resulting structure also allows to maintain the rigidity characteristics of the skate, which are furthermore necessary for the correct use of the sports implement.

As already mentioned, an equivalent embodiment is constituted by a shoe with a sole which is articulated at the hinge 11, while the first base 9 and the second base 10 of the first frame 4 and of the second frame 5 are not connected to each other.

The materials and the dimensions that constitute the individual components of the skate may of course be the most pertinent according to the specific requirements.

The disclosures in Italian Patent Application No. TV98A000078 from which this application claims priority are incorporated herein by reference.

What is claimed is:

1. A three-wheeled in-line roller skate comprising:

three in-line wheels constituted by one single front wheel, one single intermediate wheel, and one single rear wheel, said intermediate wheel being arranged between said front and real wheels;

a first front frame which rotatably supports said front wheel about a front pivot axis lying in a front vertical plane, and said first front frame rotatably supports said intermediate wheel about an intermediate pivot axis lying in an intermediate vertical plane; and a second rear frame which rotatably supports said rear wheel about a rear pivot axis lying in a rear vertical plane;

said first and second frames respectively have a first base and a second base each connected to a sole of the skate and which are mutually articulated, at one end each, by means of a hinge which is located at said sole of the skate in a region that lies approximately below the metatarsus of the foot, and said hinge lying in a vertical hinge plane which extends between said front vertical plane and said intermediate vertical plane.

2. A skate according to claim 1, wherein said hinge acts at a first seat which is formed at said sole of said skate and allows said sole to flex.

3. A skate according to claim 2, wherein said first and second frames of said sole of said skate are articulated in a region which lies approximately below the metatarsus of the foot, an adjustable fork means, adapted to bias the sole to a generally planar arrangement, being provided between said first frame and said sole.

4. A skate according to claim 3, wherein said fork means, interposed between said first frame and said sole, is constituted by a fork which is composed of two arms, the tips of which have first holes which have the same axis and form seats for coupling at a first pivot for the articulation of a wheel and said first frame.

5. A skate according to claim 4, wherein longitudinal slots are formed within said arms and a second central hole is formed at a base that connects said arms.

6. A skate according to claim 5, wherein of said arms are configured to place said base adjacent to said sole, and a tab protruding downwards from said sole.

7. A skate according to claim 6, wherein a screw is interposed between said arms and has a first threaded portion, located adjacent to a head, and a second smooth portion, proximate to a free tip of the second portion is a third diametrical through hole.

8. A skate according to claim 7, wherein the free tip of said screw is rotatably articulated at said tab by means of a second pivot which passes through said third hole and a corresponding hole formed in said tab.

9. A skate according to claim 8, wherein coaxially to said screw is spring whose ends abut against a surface of said base that is directed away from said tab and at a stop element constituted by a cap which has a substantially C-shaped transverse cross-section and is provided with a fourth axial hole which is internally threaded complementarily to said first threaded portion of said screw.

10. A three-wheeled in-line roller skate comprising:

three in-line wheels constituted by one single front wheel, one single intermediate wheel, and one single rear wheel, said intermediate wheel being arranged between said front and rear wheels;

a first front frame which rotatably supports said front wheel about a front pivot axis lying in a front vertical plane, and said first front frame rotatably supports said intermediate wheel about an intermediate pivot axis lying in an intermediate vertical plane; and a second rear frame which rotatably supports said real wheel about a rear pivot axis lying in a rear vertical plane;

said first and second frames being connected to a sole of the skate and said skate being pivotable about a skate pivot axis which is located at said sole of the skate in a region that lies approximately below the metatarsus of the foot, and said skate pivot axis lying in a vertical plate which extends between said front vertical plane and said intermediate vertical plane.

11. A skate according to claim 10, wherein said skate pivot axis is arranged at a first seat which is formed at said sole of said skate and allows said sole to flex.

12. A skate according to claim 11, wherein said first and second frames of said sole of said skate are articulated in a region which lies approximately below the metatarsus of the foot, an adjustable fork means, adapted to bias the sole to a generally planar arrangement, being provided between said first frame and said sole.

13. A skate according to claim 12, wherein said fork means, interposed between said first frame and said sole, is constituted by a fork which is composed of two arms, the tips of which have first holes which have the same axis and form seats for coupling at a first pivot for the articulation of a wheel and said first frame.

14. A skate according to claim 13, wherein longitudinal slots are formed in said arms and a second central hole is formed at a base that connects said arms.

15. A skate according to claim 14, wherein said arms are configured to place said base adjacent to said sole, and a tab protruding downwards from said sole.

16. A skate according to claim 15, wherein a screw is interposed between said arms and has a first threaded portion, located adjacent to a head, and a second smooth portion, proximate to a free tip of the second portion is a third diametrical through hole.

17. A skate according to claim 16, wherein the free tip of said screw is rotatably articulated at said tab by means of a second pivot which passes through said third hole and a corresponding hole formed in said tab.

18. A skate according to claim 17, wherein coaxially to said screw is a spring whose ends abut against a surface of said base that is directed away from said tab and at a stop element constituted by a cap which has a substantially C-shaped transverse cross-section and is provided with a fourth axial hole which is internally threaded complementarily to said first threaded portion of said screw.

* * * * *